US012735792B2

(12) United States Patent
Cai et al.

(10) Patent No.: US 12,735,792 B2
(45) Date of Patent: Sep. 15, 2026

(54) METAL STRUCTURAL MEMBER USED IN COOPERATION WITH GALLIUM-BASED LIQUID METAL, MANUFACTURING METHOD THEREFOR, AND APPLICATION THEREOF

(71) Applicant: YUNNAN ZHONGXUAN LIQUID METAL TECHNOLOGY CO., LTD, Qujing (CN)

(72) Inventors: Changli Cai, Qujing (CN); Chengdu Geng, Qujing (CN); Daotong Chen, Qujing (CN); Yingbao Yang, Qujing (CN); Jianping An, Qujing (CN); Wangli Du, Qujing (CN); Huifang Tang, Qujing (CN); Ji Zhang, Qujing (CN)

(73) Assignee: YUNNAN ZHONGXUAN LIQUID METAL TECHNOLOGY CO., LTD, Qujing (CN)

( * ) Notice: Subject to any disclaimer, the term of this patent is extended or adjusted under 35 U.S.C. 154(b) by 50 days.

(21) Appl. No.: 18/725,857

(22) PCT Filed: Aug. 29, 2022

(86) PCT No.: PCT/CN2022/115492

§ 371 (c)(1),
(2) Date: Jul. 1, 2024

(87) PCT Pub. No.: WO2023/216467

PCT Pub. Date: Nov. 16, 2023

(65) Prior Publication Data

US 2025/0075329 A1 Mar. 6, 2025

(30) Foreign Application Priority Data

May 13, 2022 (CN) ..... 202210524894.9
May 13, 2022 (CN) ..... 202221152744.1

(51) Int. Cl.
*C23C 18/32* (2006.01)
*C22C 19/03* (2006.01)
*F28F 21/08* (2006.01)

(52) U.S. Cl.
CPC ..... *C23C 18/32* (2013.01); *C22C 19/03* (2013.01); *F28F 21/089* (2013.01)

(58) Field of Classification Search
None
See application file for complete search history.

(56) References Cited

U.S. PATENT DOCUMENTS 9,666,437 B2 * 5/2017 Urano ..... H01L 21/283
2017/0335462 A1 * 11/2017 Picalek ..... C23C 18/50
2018/0312990 A1 * 11/2018 Jones ..... C25D 3/562

FOREIGN PATENT DOCUMENTS

CN 101169215 A * 4/2008
CN 109161869 A 1/2019
(Continued)

OTHER PUBLICATIONS

Yan, Hong et al. "Performance Superiority and Applications of Electroless Nickel-Based Alloy Plating", China Surface Engineering. No. 4, Dec. 31, 2001 (Dec. 31, 2001), ISSN: 1007-9289, p. 12, section 2.4, and p. 13, section 3.1.
(Continued)

*Primary Examiner* — Daniel J. Schleis
(74) *Attorney, Agent, or Firm* — Rondaus PLLC; George Liu

(57) ABSTRACT

Disclosed in the present disclosure is a metal structural member used in cooperation with a gallium-based liquid metal. A high phosphorus nickel alloy layer is arranged on a surface of the metal structural member in contact with the gallium-based liquid metal. The metal structural member does not react with the gallium-based liquid metal when it is in contact with the gallium-based liquid metal, thereby
(Continued)

avoiding a degradation of heat dissipation performance due to consumption of the gallium-based liquid metal. Further disclosed in the present disclosure are a manufacturing method for the metal structural member, and an application of the metal structural member in heat dissipation of computer chips, cell phone chips, communication products, high power LEDs, insulated gate bipolar transistors, and high power electronic products.

15 Claims, 3 Drawing Sheets

(56) References Cited

FOREIGN PATENT DOCUMENTS

| | | | |
|---|---|---|---|
| CN | 208538833 | U | 2/2019 |
| CN | 110387217 | A | 10/2019 |
| WO | 2014120086 | A1 | 8/2014 |

OTHER PUBLICATIONS

Liu, Xi et al. "Application of Electroless Ni—P Alloy in Electronic Industry" Plating & Finishing. vol. 28, No. 1, Jan. 31, 2006 (Jan. 31, 2006), ISSN: 1001-3849, p. 30, left column, paragraphs 1-2, and p. 31, right column, paragraph 3 to pp. 33, right column, last paragraph.

* cited by examiner

METAL STRUCTURAL MEMBER USED IN COOPERATION WITH GALLIUM-BASED LIQUID METAL, MANUFACTURING METHOD THEREFOR, AND APPLICATION THEREOF

CROSS-REFERENCE TO RELATED APPLICATIONS

This application claims priority to Chinese Patent Application No. 202210524894.9, titled "METAL STRUCTURAL MEMBER USED IN COOPERATION WITH GALLIUM-BASED LIQUID METAL, MANUFACTURING METHOD THEREFOR, AND APPLICATION THEREOF", and Chinese Patent Application No. 202221152744.1, titled "METAL STRUCTURAL MEMBER USED IN COOPERATION WITH GALLIUM-BASED LIQUID METAL", filed on May 13, 2022, which are incorporated herein by reference in their entirety.

TECHNICAL FIELD

The present disclosure is in the field of thermal conductivity of electronic devices, and is particularly concerned with a metal structural member used in cooperation with gallium-based liquid metal, manufacturing method therefor, and application thereof.

BACKGROUND

Due to the existence of fine uneven gaps between the surface of the electronic material and the radiator, if the electronic material and the radiator are directly mounted together, the actual contact area between them is only 10% of the radiator base area, and the rest is the air gap. Because the thermal conductivity of air is only 0.024 W/(m·K), the air gap will lead to a very large contact thermal resistance between the electronic components and the radiator, seriously hindering the conduction of heat, resulting in low efficiency of the radiator. Therefore, these gaps need to be filled with thermal interface materials with high thermal conductivity to exclude the air therein, and to establish a heat conduction channel between the electronic components and the radiator so as to substantially increase the contact area between the heat source and the radiator, reduce the contact thermal resistance, and enable the radiator to play its role well.

Thermal silicone grease is currently widely used as a traditional thermal interface material. However, with the rise of 5G communication, Internet of Things, new energy automotive electronics, wearable devices, smart cities and other fields, the related electronic devices are developing in the direction of miniaturization, high power density, multifunctionality, etc., which will make the risk of overheating of the related electronic devices continue to rise. Traditional silicone grease has low thermal conductivity and cannot meet the needs of use. The development of high-performance thermal interface materials is very critical to improve the heat dissipation of electronic devices, and has become the biggest challenge for academia and the electronic device application industry. Gallium-based liquid metal thermal interface materials have gained more and more attention in recent years due to their high thermal conductivity, which can satisfy modern high power density applications.

However, since the vast majority of radiator materials are copper, aluminum or alloys thereof, and gallium-based liquid metal can react with aluminum or alloys thereof, or with copper or alloys to form intermetallic compounds, these cases will lead to liquid-phase gallium reactive depletion, so that there is no liquid metal filling between the interfaces, resulting in failure without filling effect. Therefore, avoiding the reaction of gallium-based liquid metals with copper, aluminum, or alloys thereof is a pressing issue for the widespread use of liquid metals as thermal interface materials.

The information disclosed in this background section is intended only to add to the understanding of the general context of the present disclosure and should not be taken to acknowledge or in any way imply that the information constitutes prior art already known to those of ordinary skilled in the art.

SUMMARY

An object of the present disclosure is to provide a metal structural member used in cooperation with gallium-based liquid metal, which does not react with the gallium-based liquid metal when in contact with the gallium-based liquid metal, thereby avoiding a degradation of heat dissipation performance due to consumption of the gallium-based liquid metal. The metal structural member provided in the present disclosure solves the technical problem in prior art that the gallium-based liquid metal reacts with aluminum or its alloys in radiator materials, resulting in the consumption of liquid gallium through the reaction and ultimately leading to the drying of the interface and loss of filling effect.

In order to achieve the above object, the present disclosure provides a metal structural member used in cooperation with a gallium-based liquid metal, wherein a high phosphorus nickel alloy layer is arranged on a surface of the metal structural member in contact with the gallium-based liquid metal.

In an embodiment of the present disclosure, a phosphorus content in the high phosphorus nickel alloy layer is ≥10%.

In an embodiment of the present disclosure, a thickness of the high phosphorus nickel alloy layer is ≥1 μm; preferably, the thickness of the high phosphorus nickel alloy layer is ≥3 μm; more preferably, the thickness of the high phosphorus nickel alloy layer is ≥5 μm; most preferably, the thickness of the high phosphorus nickel alloy layer is ≥10 μm.

In an embodiment of the present disclosure, the metal structural member is a heat dissipation component in contact with the gallium-based liquid metal, a container or a cavity holding the gallium-based liquid metal, or a pipe through which the gallium-based liquid metal flows; preferably, the metal structural member is a finned radiator, a heat pipe radiator, a phase change radiator, a heat sink, a homogenizing plate, a microfluidic channel radiator, a liquid metal fluid radiator, a liquid metal pressure transducer, a liquid metal pressure transmitter, a liquid metal holding container, or a component that is in contact with the gallium-based liquid metal.

In an embodiment of the present disclosure, the surface of the metal structural member in contact with the gallium-based liquid metal is planar or curved.

In an embodiment of the present disclosure, a material of the metal structural member is selected from at least one of copper, aluminum, iron, nickel, stainless steel, titanium, zinc, gold or alloys thereof.

In an embodiment of the present disclosure, the surface of the metal structural member in contact with the gallium-based liquid metal further comprises a protective layer of composite ceramic.

In an embodiment of the present disclosure, the gallium-based liquid metal is selected from gallium metal, gallium-containing liquid alloy, gallium-containing metal oxide, gallium-containing thermal interface material, gallium-containing composite material.

Another object of the present disclosure is to provide a manufacturing method for the metal structural member, comprising: applying a high phosphorus electroless nickel plating treatment to the surface of the metal structural member in contact with the gallium-based liquid metal thermal interface material, thereby forming a high phosphorus nickel alloy layer on the surface of the metal structural member in contact with the gallium-based liquid metal. The method is technically mature and stable, with low costs.

Another object of the present disclosure is to provide an application of the metal structural member described above or the metal structural member made by the manufacturing method described above in the heat dissipation of computer chips, cell phone chips, communication products, high power Light Emitting Diode (LEDs), insulated gate bipolar transistors, and high power electronic products. The metal structural member in the present disclosure prevents the gallium-based liquid metal from reacting with the metal structural member by forming a high phosphorus nickel alloy layer on the surface of the metal structural member in contact with the gallium-based liquid metal, thereby enabling the high thermal conductivity gallium-based liquid metal to be widely used in products such as computer chips, cell phone chips, communication products, high power LEDs, insulated gate bipolar transistors, aerospace or military high power electronic products, and the like.

Compared with the prior art, the present disclosure has the following beneficial effects:

(1) In the present disclosure, a high phosphorus nickel alloy layer is arranged on the surface of the metal structural member, and the high phosphorus nickel alloy layer can form an effective protection for copper, aluminum and other metals, so that these metals do not react with the gallium-based liquid metal for a long time under extreme conditions. According to the experimental results, a high phosphorus nickel coating thicker than 1 μm can prevent the metal sheet from reacting with the gallium-based liquid metal, thus avoiding the gallium-based liquid metal from being gradually consumed through the reaction, and avoiding the decline in thermal conductivity due to the consumption of the gallium-based liquid metal thermal interface material.

(2) Although the high phosphorus nickel coating thicker than 1 μm has a good protective effect on the metal structural members, in the process of packaging, transportation and use, the high phosphorus nickel coating surface of the metal structural members such as heat sinks, homogenizing plates, etc., may be abraded or scratched, so the thickness of high phosphorus nickel coating is preferably more than 3 μm, and even more preferably more than 5 μm. In the case of more serious wear and tear or high stability requirements, long service life and other special requirements, the high phosphorus nickel coating thicker than 10 μm can be formed on the surface of the metal structural members, in order to fully ensure sufficient protection to avoid accidents.

(3) In addition, the phosphorus content in the high phosphorus nickel alloy layer is also crucial. In Comparative Embodiment 2, medium phosphorus nickel coating with phosphorus content of 9% is used as protection layer, the experimental results show that the medium phosphorus nickel coating has a certain protective effect to prevent the metal sheet and gallium-based liquid metal reaction, but the protective effect is not enough, gallium-based liquid metal finally reacted with the metal sheet.

BRIEF DESCRIPTION OF THE DRAWINGS

FIG. 4 is a photograph of a metal sheet treated according to a method of Embodiment 3 and Comparative Embodiment 1-5 of the present disclosure after being tested for coating protection effect.

DESCRIPTION OF THE MAIN ACCOMPANYING DRAWINGS MARKINGS

1—metal structural member, 2—high phosphorus nickel alloy layer, and 3—gallium-based liquid metal.

DETAILED DESCRIPTION OF THE EMBODIMENTS

Specific embodiments of the present disclosure are described in detail below in connection with the accompanying drawings of the specification, but it should be understood that the scope of protection of the present disclosure is not limited by the specific embodiments.

Throughout the specification and claims, the term "including" or variations thereof such as "comprising" or "including thereof", etc., will be understood to include the elements or components described, and not to exclude other elements or other components, unless expressly indicated otherwise.

Embodiment 1

Figure 1:
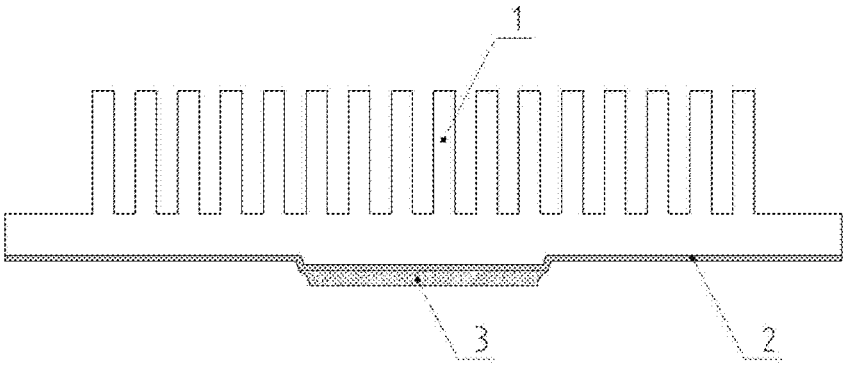
FIG. 1 is a schematic diagram of a section of a finned radiator according to an embodiment of the present disclosure.

A metal structural member 1 as shown in FIG. 1, is specifically a copper finned radiator, and a high phosphorus nickel alloy layer 2 is arranged on a bottom surface of the copper finned radiator in contact with a gallium-based liquid metal 3. The manufacturing method is as follows: the bottom surface of the copper finned radiator in contact with the gallium-based liquid metal is cleaned, subjected to a high phosphorus electroless nickel plating treatment for 5 minutes, and then taken out for drying.

By measurement, the thickness of the high phosphorus nickel alloy layer formed on the bottom surface of the copper finned radiator is 1.2 μm, and the phosphorus content in the high phosphorus nickel alloy layer is 10%. For the convenience of subsequent experiments, a 2 mm copper sheet is synchronized to be subjected to high phosphorus electroless nickel plating treatment, and then the treated copper sheet is used instead of the copper finned radiator as the test object of Embodiment 1.

Embodiment 2

Figure 2:
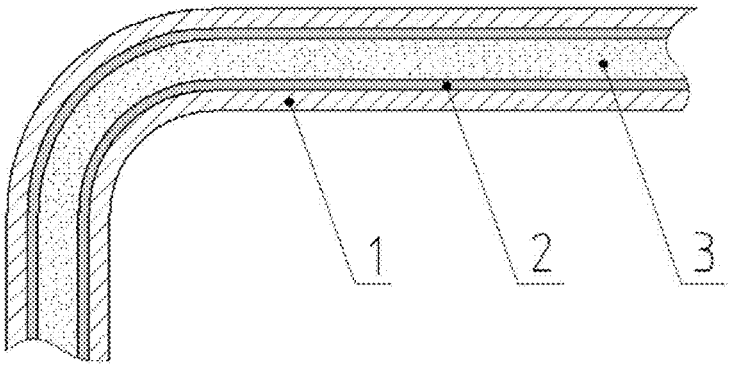
FIG. 2 is a schematic diagram of a section of a heat pipe of a heat pipe radiator according to an embodiment of the present disclosure.

A metal structural member 1 as shown in FIG. 2, is specifically a heat pipe of a copper heat pipe radiator, and a high phosphorus nickel alloy layer 2 is arranged on an inner surface of the heat pipe of the copper heat pipe radiator in contact with the gallium-based liquid metal 3. The manufacturing method is as follows: the inner surface of the heat pipe of the copper heat pipe radiator in contact with the gallium-based liquid metal is cleaned, subjected to a high phosphorus electroless nickel plating treatment for 18 μminutes, and then taken out for drying.

By measurement, the thickness of the high phosphorus nickel alloy layer formed on the surface of the homogenizing plate is 3 μm, and the phosphorus content in the high phosphorus nickel alloy layer is 12%. For the convenience of subsequent experiments, a 2 mm copper sheet is synchronized to be subjected to high phosphorus electroless nickel plating treatment, and then the treated copper sheet is used instead of the copper heat pipe as the test object of Embodiment 2.

Embodiment 3

Figure 3:
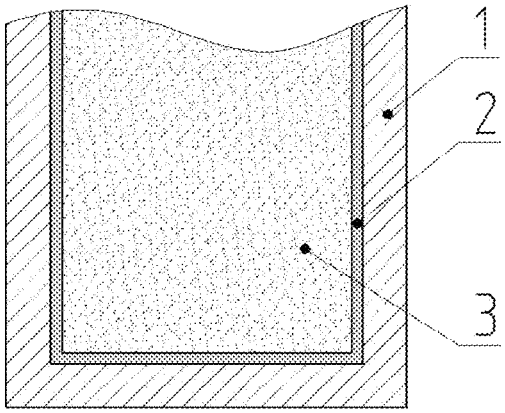
FIG. 3 is a schematic diagram of a section of a liquid metal holding container according to an embodiment of the present disclosure.
Figure 4A:
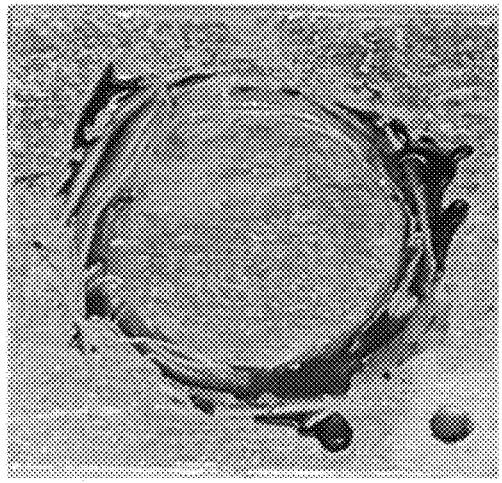
FIG. 4A shows High Phosphorus Nickel 5 μm Coating (After Cleaning)
Figure 4B:
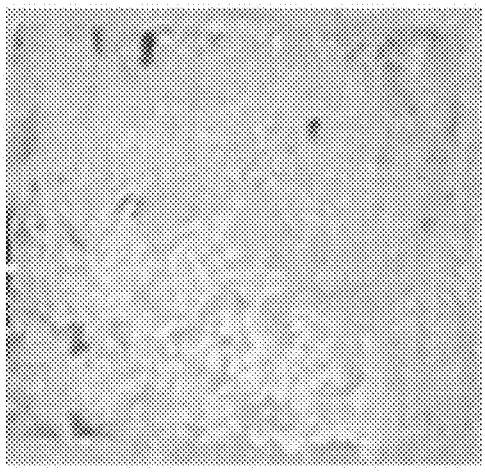
FIG. 4B shows Pure Copper Without Coating (After Cleaning)
Figure 4C:
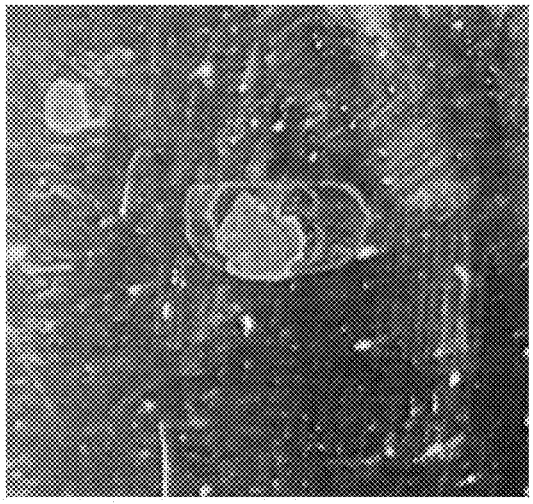
FIG. 4C shows Medium Phosphorus Nickel 5 μm Coating (After Cleaning)
Figure 4D:
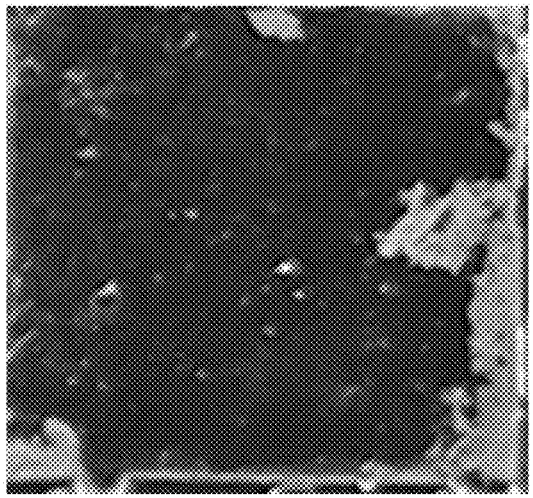
FIG. 4D shows Chromium Plating 5 μm (After Cleaning)
Figure 4E:
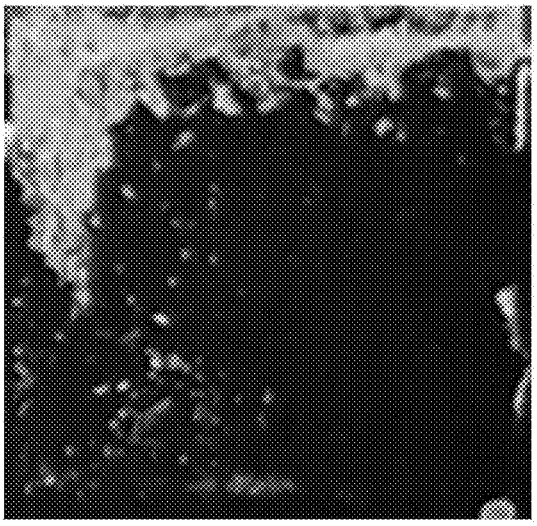
FIG. 4E shows Electroless Nickel plating 5 μm (After Cleaning)
Figure 4F:
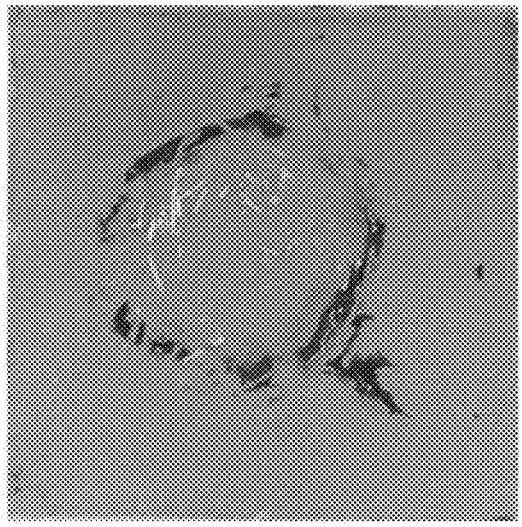
FIG. 4F shows Ceramic 207E Coating (After Cleaning).

A metal structural member 1 as shown in FIG. 3, is specifically a copper liquid metal container, and a high phosphorus nickel alloy layer 2 is arranged on an inner surface of the copper liquid metal container in contact with a gallium-based liquid metal 3. The manufacturing method is as follows: the inner surface of the copper liquid metal container in contact with the gallium-based liquid metal is cleaned, subjected to a high phosphorus electroless nickel plating treatment for 24 minutes, and then taken out for drying.

By measurement, the thickness of the high phosphorus nickel alloy layer formed on the inner surface of the copper liquid metal container is 5 μm, and the phosphorus content in the high phosphorus nickel alloy layer is 11%. For the convenience of subsequent experiments, a 2 mm copper sheet is synchronized to be subjected to high phosphorus electroless nickel plating treatment, and then the treated copper sheet is used instead of the copper liquid metal container as the test object of Embodiment 3.

Embodiment 4

A copper microfluidic channel radiator, wherein a high phosphorus nickel alloy layer is arranged on an inner and outer surfaces of the copper microfluidic channel radiator in contact with a gallium-based liquid metal. The inner and outer surfaces of the copper microfluidic channel radiator in contact with the gallium-based liquid metal is cleaned, subjected to a high phosphorus electroless nickel plating treatment for 40 minutes, and then taken out for drying.

By measurement, the thickness of the high phosphorus nickel alloy layer formed on the inner and outer surfaces of the copper microfluidic channel radiator is 10 m, and the phosphorus content in the high phosphorus nickel alloy layer is 10%. For the convenience of subsequent experiments, a 2 mm copper sheet is synchronized to be subjected to high phosphorus electroless nickel plating treatment, and then the treated copper sheet is used instead of the copper microfluidic channel radiator as the test object of Embodiment 4.

Embodiment 5

An aluminum heat sink, wherein a high phosphorus nickel alloy layer is arranged on a bottom surface of the aluminum heat sink in contact with a gallium-based liquid metal. The bottom surface of the aluminum heat sink in contact with the gallium-based liquid metal is cleaned, subjected to a high phosphorus electroless nickel plating treatment for 20 minutes, and then taken out for drying.

By measurement, the thickness of the high phosphorus nickel alloy layer formed on the bottom surface of the aluminum heat sink is 5 μm, and the phosphorus content in the high phosphorus nickel alloy layer is 10%. For the convenience of subsequent experiments, a 2 mm aluminum sheet is synchronized to be subjected to high phosphorus electroless nickel plating treatment, and then the treated aluminum sheet is used instead of the aluminum heat sink as the test object of Embodiment 5.

Embodiment 6

A copper alloy heat sink, wherein a high phosphorus nickel alloy layer is arranged on a bottom surface in contact with a gallium-based liquid metal. The bottom surface of the copper alloy heat sink in contact with the gallium-based liquid metal is cleaned, subjected to high phosphorus electroless nickel plating treatment for 20 minutes, and then taken out for drying.

By measurement, the thickness of the high phosphorus nickel alloy layer formed on the bottom surface of the copper alloy heat sink is 5 μm, and the phosphorus content in the high phosphorus nickel alloy layer is 10%. For the convenience of subsequent experiments, a 2 mm copper alloy sheet is used instead of the copper alloy heat sink to be subjected to high phosphorus electroless nickel plating treatment, and as the test object of Embodiment 6.

Embodiment 7

An aluminum alloy heat sink, wherein a high phosphorus nickel alloy layer is arranged on a bottom surface of the aluminum alloy heat sink in contact with a gallium-based liquid metal. The bottom surface of the aluminum alloy heat sink in contact with the gallium-based liquid metal is cleaned, subjected to high phosphorus electroless nickel plating treatment for 29 minutes, and then taken out for drying.

By measurement, the thickness of the high phosphorus nickel alloy layer formed on the bottom surface of the aluminum alloy heat sink is 5 μm, and the phosphorus content in the high phosphorus nickel alloy layer is 10%. For the convenience of subsequent experiments, a 2 mm aluminum alloy sheet is used instead of the aluminum alloy heat sink to be subjected to high phosphorus electroless nickel plating treatment, and as the test object of Embodiment 7.

Embodiment 8

A stainless steel heat sink, wherein a high phosphorus nickel alloy layer is arranged on a bottom surface of the stainless steel heat sink in contact with a gallium-based liquid metal. The bottom surface of the stainless steel heat sink in contact with the gallium-based liquid metal is cleaned, subjected to high phosphorus electroless nickel plating treatment for 29 minutes, and then taken out for drying.

By measurement, the thickness of the high phosphorus nickel alloy layer formed on the bottom surface of the stainless steel heat sink is 5 μm, and the phosphorus content in the high phosphorus nickel alloy layer is 10%. For the convenience of subsequent experiments, a 2 mm stainless steel sheet is used instead of the stainless steel heat sink to be subjected to high phosphorus electroless nickel plating treatment, and as the test object of Embodiment 8.

Comparative Embodiment 1

The surface of a 2 mm copper sheet is cleaned without any treatment.

Comparative Embodiment 2

The surface a 2 mm copper sheet is cleaned, subjected to a medium phosphorus electroless nickel plating treatment for 18 minutes, and then taken out for drying. By measurement, the thickness of the medium phosphorus nickel alloy layer formed on the surface of the copper sheet is 5 μm, and the phosphorus content in the medium phosphorus nickel alloy layer is 9%.

Comparative Embodiment 3

The surface of a 2 mm copper sheet is cleaned, subjected to the chromium plating treatment. By measurement, the thickness of the electroplated chrome layer formed on the surfaces of the copper sheet is 5 μm.

Comparative Embodiment 4

The surface of a 2 mm copper sheet is cleaned, subjected to the electroless nickel plating treatment. By measurement, the thickness of the electroplated nickel layer formed on the surfaces of the copper sheet is 5 μm.

Comparative Embodiment 5

The surface of a 2 mm copper sheet is cleaned, and coated with 207E high thermal conductivity ceramic coating. By measurement, the thickness of the high thermal conductivity ceramic layer formed on the surfaces of the copper sheet is 5 μm.

Experimental Example Test of Coating Protection Effect

The metal sheets treated according to the methods of Embodiments 1-8 and Comparative Embodiments 1-4 are used as test objects. Every two metal sheets to be tested are divided into a group. One of the two metal sheets is coated with gallium-based liquid metal at the middle position, sealant is coated around the liquid metal to prevent leakage of the liquid metal, and the other metal sheet is fixed together with the aforementioned liquid metal-coated metal sheet with clamps to keep a gap of about 1 mm between the two metal sheets. Each group of fixed metal sheets is placed into a programmable constant temperature and humidity test chamber for high and low temperature cycling tests. One cycle is conducted at −40° C. and 80° C. for 30 μmin each, and the number of cycle tests is 1000 times. At the end of the test, the metal sheets of each group are separated and the liquid metal is removed to see how the metal sheets reacted with the liquid metal. The test results are shown in Table 1 below:

TABLE 1

Test results

| Sample | Reaction of metal sheet with liquid metal |
|---|---|
| Embodiment 1 | No reaction mark |
| Embodiment 2 | No reaction mark |
| Embodiment 3 | No reaction mark |
| Embodiment 4 | No reaction mark |
| Embodiment 5 | No reaction mark |
| Embodiment 6 | No reaction mark |
| Embodiment 7 | No reaction mark |
| Embodiment 8 | No reaction mark |
| Comparative Embodiment 1 | There are slight reaction marks on the surface of the pure copper metal sheet, with an area of about 35% |
| Comparative Embodiment 2 | There are slight reaction marks on the surface of the metal sheet coating, with an area of about 5% |
| Comparative Embodiment 3 | There are slight reaction marks on the surface of the metal sheet coating, with an area of about 15% |
| Comparative Embodiment 4 | There are slight reaction marks on the surface of the metal sheet coating, with an area of about 25% |
| Comparative Embodiment 5 | There are slight reaction marks on the surface of the metal sheet coating, with an area of about 3% |

The test results show that there is no reaction mark on the surfaces of the metal sheets with the high phosphorus nickel alloy layer treated in accordance with Embodiments 1-8, and the surface of the coating could be cleaned. There are small areas of reaction marks on the surfaces of Comparative Embodiment 2 and 5, and there are larger areas of reaction marks on the surfaces of Comparative Embodiment 1, 3 and 4.

According to the test results, a high phosphorus nickel coating of 1 μm or more can prevent the metal sheet from reacting with the gallium-based liquid metal, thus avoiding the gallium-based liquid metal from being gradually consumed through the reaction, and avoiding the decline in thermal conductivity due to the consumption of the gallium-based liquid metal thermal interface material. Although the high phosphorus nickel coating thicker than 1 μm has a good protective effect on the metal structural members, but in the process of packaging, transportation and use, the high phosphorus nickel coating surface of the metal structural members such as heat sinks, homogenizing plates, etc., may be abraded or scratched, so the thickness of high phosphorus nickel coating is preferably more than 3 μm, and even more preferably more than 5 μm. In the case of more serious wear and tear or high stability requirements, long service life and other special requirements, the high phosphorus nickel coating layer thicker than 10 μm can be formed on the surface of the metal structural members, in order to fully ensure sufficient protection to avoid accidents.

The surface of the untreated copper sheet of Comparative Embodiment 1 is not cleaned well, and the area of reaction marks accounts for about 35% of the total area. These facts indicate that the metal sheet is capable of reacting with the gallium-based liquid metal, which can lead to a decrease in thermal conductivity due to consumption of the gallium-based liquid metal thermal interface material. There are some reaction marks on the surfaces of the metal sheets with the medium phosphorus nickel coating of Comparative Embodiment 2, and the area of reaction marks accounts for about 5% of the contact area with the gallium-based liquid metal, which is significantly less than Comparative Embodiment 1. These facts indicate that the medium phosphorus nickel coating with phosphorus content of 9% has protective effect to prevent reactions between the metal sheet and gallium-based liquid metal. However, the protective effect is not sufficient, and the gallium-based liquid metal eventually reacted with the metal sheet. Comparative Embodiment 3-5 have similar effects to Comparative Embodiment 2. There are some reaction marks on coating surfaces of the metal sheets of Comparative Embodiment 3 coated with the electroplated chrome layer, Comparative Embodiment 4 coated with the electroplated nickel layer, and Comparative Embodiment 5 coated with the ceramic layer, and the areas of the reaction marks for Comparative Embodiment 3, Comparative Embodiment 4, and Comparative Embodiment 5 are 15%, 25%, and 3%, respectively, which are significantly less than that of Comparative Embodiment 1. These facts indicate that the electroplated chrome layer, the electroplated nickel layer, and the ceramic layer all play a certain protective role in preventing the metal sheet from reacting with the gallium-based liquid metal, but the protective strength is significantly weaker than that of the high phosphorus nickel plating layer.

The foregoing description of specific exemplary embodiments of the present disclosure is for purposes of illustration and exemplification. These descriptions are not intended to limit the present disclosure to the precise form disclosed, and it is clear that many alterations and variations are possible in light of the above teachings. The exemplary embodiments have been selected and described for the purpose of explaining particular principles of the present disclosure and their practical application so as to enable those skilled in the art to realize and utilize a variety of different exemplary embodiments of the present disclosure, as well as a variety of different selections and variations. The scope of the present disclosure is intended to be limited by the claims and their equivalent forms.

What is claimed is:

1. A combination of a metal structural member and a gallium-based liquid metal, wherein a high phosphorus nickel alloy layer is arranged on a surface of the metal structural member in contact with the gallium-based liquid metal.

2. The combination of the metal structural member and the gallium-based liquid metal according to claim 1, wherein a phosphorus content in the high phosphorus nickel alloy layer is ≥10%.

3. The combination of the metal structural member and the gallium-based liquid metal according to claim 1, wherein a thickness of the high phosphorus nickel alloy layer is ≥1 μm.

4. The combination of the metal structural member and the gallium-based liquid metal according to claim 3, wherein the thickness of the high phosphorus nickel alloy layer is ≥3 μm.

5. The combination of the metal structural member and the gallium-based liquid metal according to claim 4, wherein the thickness of the high phosphorus nickel alloy layer is ≥5 μm.

6. The combination of the metal structural member and the gallium-based liquid metal according to claim 5, wherein the thickness of the high phosphorus nickel alloy layer is ≥10 μm.

7. The combination of the metal structural member and the gallium-based liquid metal according to claim 1, wherein the metal structural member is a component in contact with the gallium-based liquid metal, a container or a cavity holding the gallium-based liquid metal, or a pipe through which the gallium-based liquid metal flows.

8. The combination of the metal structural member and the gallium-based liquid metal according to claim 7, wherein the metal structural member is a finned radiator, a heat pipe radiator, a phase change radiator, a heat sink, a homogenizing plate, a microfluidic channel radiator, a liquid metal fluid radiator, a liquid metal pressure transducer, a liquid metal pressure transmitter, a liquid metal holding container, or a component that is in contact with the gallium-based liquid metal.

9. The combination of the metal structural member and the gallium-based liquid metal according to claim 1, wherein the surface of the metal structural member in contact with the gallium-based liquid metal is planar or curved.

10. The combination of the metal structural member and the gallium-based liquid metal according to claim 1, wherein a material of the metal structural member is selected from at least one of copper, aluminum, iron, nickel, titanium, zinc, gold or alloys thereof.

11. The combination of the metal structural member and the gallium-based liquid metal according to claim 1, wherein the surface of the metal structural member in contact with the gallium-based liquid metal further comprises a nanocomposite ceramic coating.

12. The combination of the metal structural member and the gallium-based liquid metal according to claim 1, wherein the gallium-based liquid metal is any one or more selected from gallium metal, gallium-containing liquid alloy, gallium-containing metal oxide, gallium-containing thermal interface material, gallium-containing composite material.

13. The combination of the metal structural member and the gallium-based liquid metal according to claim 1, wherein a material of the metal structural member is stainless steel.

14. A manufacturing method for the metal structural member according to claim 1, wherein the method comprises: applying a high phosphorus electroless nickel plating treatment to the surface of the metal structural member in contact with the gallium-based liquid metal thermal interface material, thereby forming a high phosphorus nickel alloy layer on the surface of the metal structural member in contact with the gallium-based liquid metal.

15. An application of the combination of the metal structural member and the gallium-based liquid metal according to claim 1 in the heat dissipation of computer chips, cell phone chips, communication products, high power Light Emitting Diode (LEDs), insulated gate bipolar transistors, and high power electronic products.

* * * * *